US005779568A

United States Patent [19]

Turner et al.

[11] Patent Number: 5,779,568

[45] Date of Patent: Jul. 14, 1998

[54] PORTABLE BATTING TRAINING SYSTEM

[76] Inventors: Hilton L. Turner; Opal Tuner, both of 16640-A Prine Rd., Citionelle, Ala. 36522

[21] Appl. No.: 758,707

[22] Filed: Dec. 3, 1996

[51] Int. Cl.[6] ..... A63B 69/00

[52] U.S. Cl. ..... 473/423

[58] Field of Search ..... 473/423, 424, 473/426, 430, 429, 108, 197, 213

[56] References Cited

U.S. PATENT DOCUMENTS

| | | | |
|---|---|---|---|
| 4,573,679 | 3/1986 | Janszen | 473/427 |
| 4,674,744 | 6/1987 | Wash | 473/430 |
| 4,867,448 | 9/1989 | Judd | 473/426 |
| 5,072,937 | 12/1991 | Zarate | 473/426 |
| 5,098,094 | 3/1992 | Kita | 473/423 |
| 5,505,443 | 4/1996 | Padilla | 473/430 |
| 5,531,438 | 7/1996 | Corley | 473/429 |

*Primary Examiner*—Theatrice Brown

*Attorney, Agent, or Firm*—Joseph N. Breaux

[57] ABSTRACT

A portable batting training system comprising a foldable "T" frame and at least one baseball. The foldable "T" frame comprises two horizontal frame members and a vertical frame member wherein one distal end thereof couples to the center of one of the two horizontal frame members and the other distal end thereof couples to the center of the other of the two horizontal frame members. The at least one baseball couples to a bottom surface of one of the two horizontal frame members wherein the at least one baseball is suspended in mid-air.

3 Claims, 2 Drawing Sheets

PORTABLE BATTING TRAINING SYSTEM

TECHNICAL FIELD

The present invention relates to a batting training device and, more particularly, to a portable batting training system which suspends a ball in mid-air so that a batter may repeatedly hit the ball and visually inspect his or her performance.

BACKGROUND OF THE INVENTION

Little league sports, amateur sports and professional sports are ever increasing in popularity. As a result, for an athlete to be selected, for a certain team, is highly competitive. In order to increase an athlete's abilities, practice and training are a must. Traditionally, special coaches and other professionals have trained athletes. However, the individual training is quite costly. Henceforth, several batting training apparatuses have been designed to train baseball athletes but they do not meet the needs of the apparatus of the present invention.

SUMMARY OF THE INVENTION

The preferred embodiment of the portable batting training system of the present invention solves the aforementioned problems in a straight forward and simple manner. What is provided is a portable batting training system which suspends at least one baseball in mid-air so that a batter may repeatedly hit the ball and visually inspect his or her performance.

In particular, the portable batting training system comprising a foldable "T" frame and at least one baseball. The foldable "T" frame comprises two horizontal frame members and a vertical frame member wherein one distal end thereof couples to the center of one of the two horizontal frame members and the other distal end thereof couples to the center of the other of the two horizontal frame members. The at least one baseball couples to a bottom surface of one of the two horizontal frame members wherein the at least one baseball is suspended in mid-air.

In view of the above, an object of the invention is to provide a portable batting training system which can be used by more than one batter.

Another object of the invention is to provide a portable batting training system which is safe and effective.

A further object of the invention is to provide a portable batting training system which enables a video camera to record the front view of a batter's shoulders and arms.

It is a still further object of the invention to provide a portable batting training system which shields the batter's eyes from excessive sunlight.

It is a still further object of the invention to provide a portable batting training system which provides extra lighting for nighttime training and backlighting when the training is recorded via a video camera.

In view of the above objects, it is a feature of the invention to provide a portable batting training system which is easy to use, inexpensive and simple to manufacture.

The above objects and other feature of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
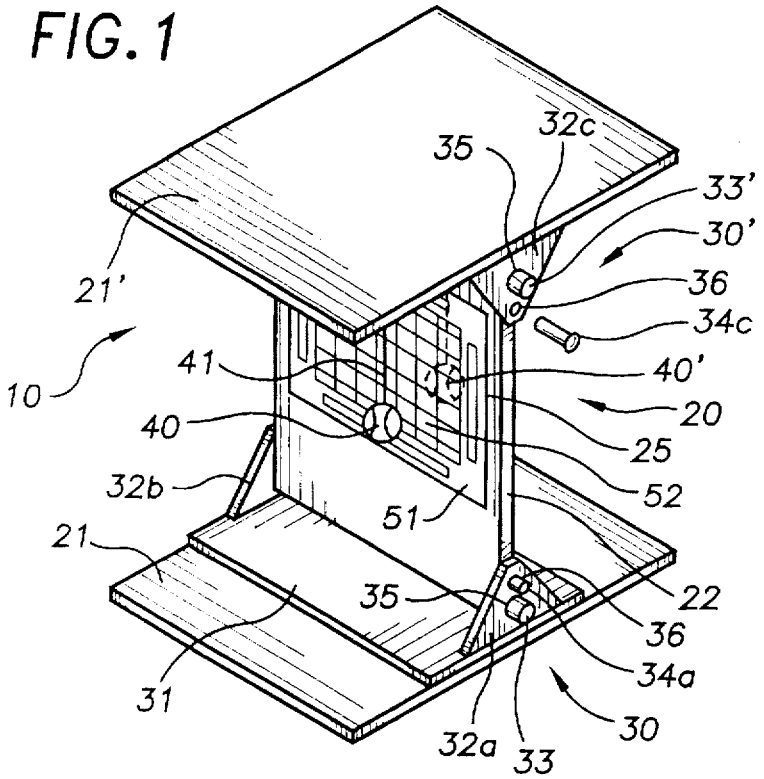
FIG. 1 illustrates a perspective view of the portable batting training system of the present invention.
Figure 2:
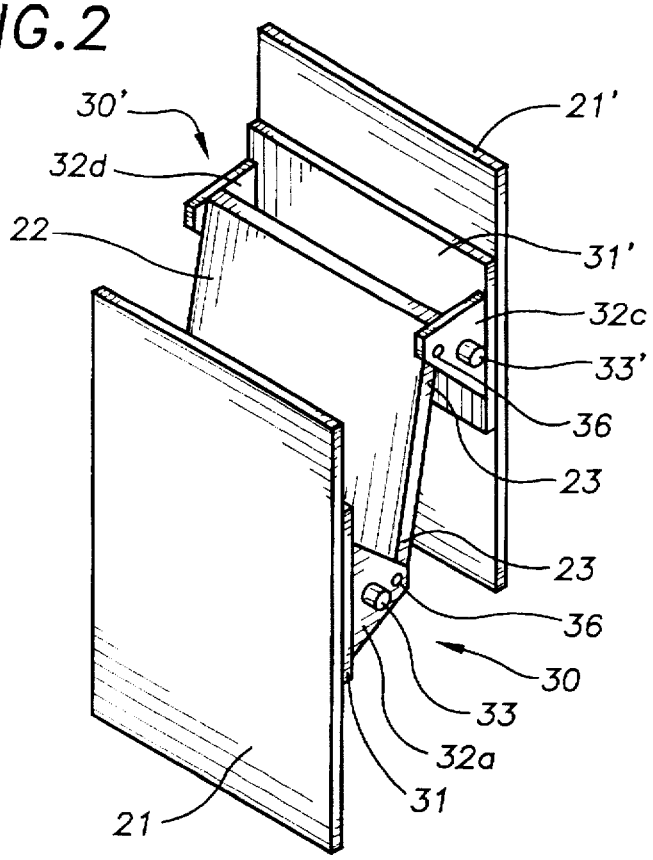
FIG. 2 illustrates a perspective view of the portable batting training system in a folded position of the present invention.

Referring now to the drawings, and in particular FIGS. 1 and 2, the portable batting training system of the present invention is designated generally by the numeral 10. Portable batting training system 10 is comprised of foldable "T" frame 20, two pivotable securing means 30 and 30', at least one baseball 40, and visual aid means 50.

Foldable "T" frame 20 comprises two horizontal frame members 21 and 21' and vertical frame member 22. Horizontal frame member 21 provides a ground base support means for supporting vertical frame member 22 in a vertical position. Horizontal frame member 21' provides a roof means for eliminating excessive sunlight from the batter's eyes and supports the at least one baseball 40 in mid-air via support cord 41. The top and bottom portion of vertical frame member 22 each has formed therein a conduit (not shown) and four pin apertures 23. Vertical frame member 22 has further formed therein window 25 wherein window 25 is positioned substantially in the upper half of vertical frame member 22. In the preferred embodiment, portable "T" frame 20 is made of plastic or the like, such as polyethylene. The dimensions of foldable "T" frame 20 will vary in accordance with the age and height of the batter.

The two pivotable securing means 30 and 30' enables foldable "T" frame 20 to be easily folded for portability of portable batting training system 10. Since the two pivotable securing means 30 and 30' are identical, only one such pivotable securing means will be described in detail. Pivotable securing means 30 comprises pivot support base 31, pivot support brackets **32*a* and 32*b*, pivot rod 33 and two securing locking pins (only 34*a*** is shown).

Each distal end of pivot support base 31 has fixedly coupled thereto pivot support brackets **32*a* and 32*b*, respectively. Pivot support brackets 32*a* and 32*b* each has formed therein rod aperture 35 and locking pin aperture 36. Pivot rod 33 is received in the bottom conduit (not shown) of vertical frame member 22 via rod apertures 35 of pivot support brackets 32*a* and 32*b* for securing vertical frame member 22 to pivot support base 31. Locking pin apertures 36 and the corresponding pin apertures 23 of vertical frame member 22 receive therein a respective one of the two secure locking pins (only 34*a* is shown) for securing horizontal frame members 21 perpendicularly to vertical frame member 22**.

Pivotable securing means 30' comprises pivot support base 31', pivot support brackets **32*c* and 32*d*, pivot rod 33' and two securing locking pins (only 34*c*** is shown).

At least one baseball 40 is fixedly coupled to horizontal frame member 21' via support cord 41 wherein the at least one baseball 40 is positioned a suitable distance from vertical frame member 22. In the exemplary embodiment of FIG. 1, two baseballs 40 and 40' are shown suspended in mid-air on opposite sides of vertical frame member 22. Henceforth, two batters may practice and/or train simultaneously wherein one batter will train using baseball 40 and the other batter will train using baseball 40'.

Visual aid means 50 comprises panel 51 and matrix 52. Panel 51 is made of a clear acrylic plastic. Formed in the clear acrylic plastic is matrix 52, a plurality of squares. The squares are used as a swing indicator. Optionally, the panel 51 may be coated with a reflective mirror coating so that each batter may visually see his or her performance.

Figure 3:
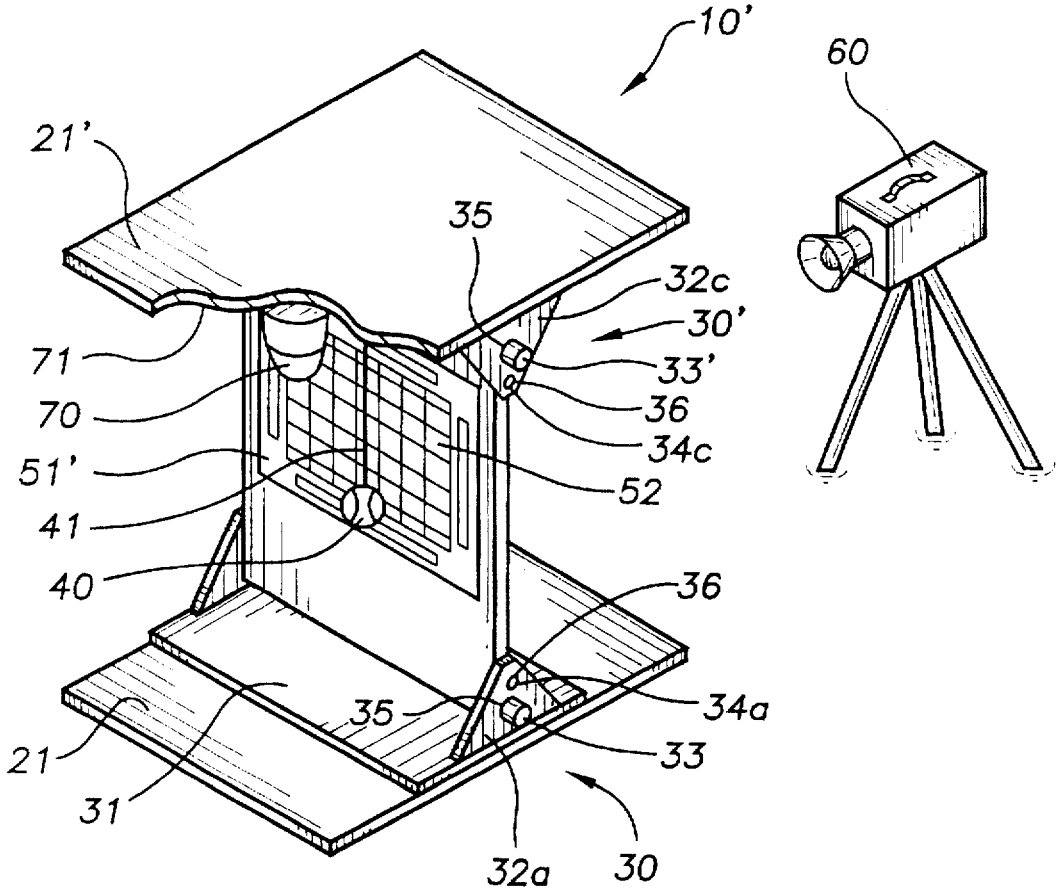
FIG. 3 illustrates a perspective view of an alternative embodiment of the portable batting training system of the present invention.

Referring to FIG. 3, an alternative embodiment of portable batting training system 10' of the present invention differs from FIG. 1 only in that the back of panel 51' has a one-way reflective mirror type coating covering the back of panel 51'. Modifying panel 51' with the one-way reflective mirror type coating allows the batter to see himself or herself in one mirror for developing their perfect batting stand. Additionally, a coach standing on the opposite side will be able to view the batter from the other side of foldable "T" frame 20. Moreover, video camera 60 may be placed on the opposite side of foldable "T" frame 20 and record the batting training for future critiquing of the batting training.

Portable batting training system 10' further comprises at least one lighting means 70. The bottom surface 71 of horizontal frame member 21' has coupled thereto lighting means 70 for providing lighting during the evening and night hours and backlighting for the video camera 60. Moreover, two lighting means 70 may be provided on each side of vertical frame member 22. Preferably, lighting means 70 is a battery powered light.

In operation, horizontal frame members 21 and 21' are positioned until foldable "T" frame 20 forms an "I." The four locking pins (only 34*a* and 34*c* are shown) are each coupled through their respective locking pin aperture 36 and into the corresponding pin aperture of vertical frame member 22. The batter equipped with protective equipment proceeds to repeatedly hit the at least one baseball 40. Alternatively, depending on the time of day, the at least one lighting means 70 will be turned on.

It is noted that the embodiment of the portable batting training system 10 described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A batting training system comprising:

an "T" frame; and at least one baseball coupled to said "T" frame wherein said at least one baseball is suspended in mid-air;

said "T" frame comprising:

two horizontal frame members; and a vertical frame member wherein one distal end thereof couples to the center of one of the two horizontal frame members and the other distal end thereof couples to the center of the other of the two horizontal frame members; said vertical frame member having formed therein a window.

2. A portable batting training system comprising:

a foldable "T" frame; and at least one baseball coupled to said "T" frame wherein said at least one baseball is suspended in mid-air;

said foldable I-frame comprising:

two horizontal frame members; and a vertical frame member wherein one distal end thereof couples to the center of one of the two horizontal frame members and the other distal end thereof couples to the center of the other of the two horizontal frame members;

said vertical frame member having formed therein a window.

3. A portable batting training system comprising:

a foldable "T" frame, said foldable "T" frame comprises:

two horizontal frame members, and a vertical frame member wherein one distal end thereof couples to the center of one of the two horizontal frame members and the other distal end thereof couples to the center of the other of the two horizontal frame members; and at least one baseball coupled to a bottom surface of one of the two horizontal frame members wherein said at least one baseball is suspended in mid-air.

* * * * *